US005266041A

United States Patent [19]

De Luca

[11] Patent Number: 5,266,041

[45] Date of Patent: Nov. 30, 1993

[54] LOADSWITCHING BUSHING CONNECTOR FOR HIGH POWER ELECTRICAL SYSTEMS

[76] Inventor: Carlo B. De Luca, 265 Glenbriar Cir., Daytona Beach, Fla. 32114

[21] Appl. No.: 825,510

[22] Filed: Jan. 24, 1992

[51] Int. Cl.[5] ..... H01R 13/53

[52] U.S. Cl. ..... 439/184; 439/921

[58] Field of Search ..... 439/180–187, 439/265, 268, 921

[56] References Cited

U.S. PATENT DOCUMENTS

| | | | |
|---|---|---|---|
| 3,314,041 | 4/1967 | Potterin | 439/346 |
| 3,509,516 | 4/1970 | Phillips | 439/184 |
| 3,513,437 | 5/1970 | McMorris | 439/184 |
| 3,539,972 | 11/1970 | Ruete et al. | 439/185 |
| 3,542,986 | 11/1970 | Kotski | 439/184 |
| 3,639,883 | 2/1972 | Drapkin | 439/107 |
| 3,663,928 | 3/1972 | Keto et al. | 439/184 |
| 3,713,077 | 1/1973 | Leonard | 439/184 |
| 3,813,639 | 5/1974 | Schurter et al. | 439/184 |
| 3,860,322 | 1/1975 | Sankey et al. | 439/184 |
| 3,917,374 | 11/1975 | Murdock | 439/184 |
| 3,982,812 | 9/1976 | Boliver | 439/184 |
| 4,068,913 | 1/1978 | Stanger et al. | 439/185 |

*Primary Examiner*—Gary F. Paumen

[57] ABSTRACT

Disclosed is an electrical bushing connector (10) designed to complete a power circuit connection to a transformer or the like typically employed in a primary power distribution system. The connector will also afford capability to switch high power electrical loads. The connector will mate with and make electrical connection with a loadbreak terminator (50) as used in such systems so that an electrical circuit carrying high currents at elevated voltages may be broken in the field without harm to the service personnel making and breaking the connection. Additionally, the connector can safely connect high energy fault currents. The connector allows the design to be compatible with existing interchangeability standards. The connector is electrically isolated from the environment prior to the terminator being inserted into the bushing connector to complete a circuit. Additionally, the connector has facility to rapidly close the circuit and also to rapidly open the circuit upon connection and disconnection, thereby minimizing arcing times. The connector also has the capability to block any passage of ionized gasses as the terminator is exiting the connector, thus preventing resultant arcs in the environment from being created due to the ionized gases.

15 Claims, 3 Drawing Sheets

LOADSWITCHING BUSHING CONNECTOR FOR HIGH POWER ELECTRICAL SYSTEMS

BACKGROUND—FIELD OF INVENTION

This invention receives a mating loadbreak terminator of design compatible, but not limited to, interface configurations such as described in ANSI/IEEE Standard 386-1985 and subsequent revisions in 1990. In cooperation with this terminator, the invention provides facility for accelerated make and break electrical switching and immediately insulates and isolates the contacts upon break.

BACKGROUND—CROSS-REFERENCE TO RELATED APPLICATIONS

This invention is similar to the product described in U.S. Pat. No. 3,813,639 to Schurter and De Luca, May 28, 1974; however, it provides mechanism to allow performance for higher power switching.

BACKGROUND—DISCUSSION OF PRIOR ART

Heretofore, it was well recognized that arcing generated during the switching operations creates gasses which act to produce pressure, making connecting on a high voltage fault current by hand very difficult, damaging the connector, and striking an arc to ground potential, resulting in a catastrophic fault current. While efforts at reducing the pressure were effective for predominant voltages relating to the application at the time, increased use of higher voltages, which produce longer arching times, required further development. Systems were developed to reduce arcing time by providing moving contacts which require an additional connection device to the circuit. Movement is actuated by the gasses first generated by arcing, generally requiring an unusually high energy fault current arc. These systems require pistons, moving contact surfaces and the such which tend to have limited life because they must provide high current passage while moving, and add an extra current carrying member. Further, these systems are only actuated after the high energy arc has already struck and created high pressure for the mechanism to function. Such solutions are described in U.S. Pat. Nos. 3,542,986 to Kotski, November 1970, and 4,068,913 to Stanger et al, January 1978. Other attempts were made to mechanically move the contacts quickly upon operation, for example, in U.S. Pat. No. 3,713,077 to Leonard, January 23. However, this solution requires the use of a particular terminator or electrode probe design, and is not interchangeable with any of the terminators being used and produced by the industry. Also, Leonard does not provide protection against initial arc striking before the contact functions, which can produce excessive pressure prior to contact closure. The aforementioned requirement for interchangeability is specified by the Electric Power Utilities using this product to insure proper operation of the products in the field upon replacement, to insure proper purchasing procedures, and to promote safety. My invention allows interchangeability because the concept allows design in accordance with the existing ANSI/IEEE standards.

While the gasses produced, particularly upon fault close, create pressures which can prevent connection, gasses produced on disconnection (loadbreak) cause another catastrophic failure. These gasses are ionized and electrically conductive, and tend to escape through the opening in the bushing receptacle entrance when the probe exists. Initially, the arcing gasses create an electrical path from the bushing connector to the terminator connector in the channel between the terminator electrode and the opening in the bushing. When the probe exists with the arc, it results in an open arc in the air. The open arc invariably strikes an adjacent ground plane, thereby causing an arc to ground and a fault current. Solutions to this problem have been approached by blocking the opening while the terminator is exiting the bushing using sealing rings, or by using a flapper valve to block gas escape after the terminator has exited. Examples of this are in U.S. Pat. Nos. 3,860,322 to Sankey et al, Jan. 14, 1975 and 3,982,812 to Boliver, Sep. 28, 1976. This resolution allows blockage of the opening only after the arc suppressing dielectric portion of the probe exists the contact area, allowing the arc to extend out of the bushing before the gasses can be blocked. It can be seen that my invention provides gas blockage immediately upon contact separation, thus not allowing any arc extension past the receptacle contact and totally minimizing the creation of such arcs. The creation of such ionized gasses has become more apparent recently because of problems experienced during loadbreak at lower than maximum rated amperages. It can be expected that this occurs when the arc energy is not of sufficient energy to activate the arc quenching material and create adequate quenching gasses. These gasses are very conductive and are more problematic. In addition to blocking the air path immediately upon contact separation, my invention provides a blockage of further arcing in the event that the arc created is not of sufficient energy to produce adequate quenching gasses.

OBJECTS AND ADVANTAGES

It is, therefore, an object of the invention to provide a new and improved connector for use with a loadbreak terminator, and capable of accepting existing terminators in the field in accordance with ANSI/IEEE 386 interchangeability requirements.

It is a further object of the invention to provide a connector within which a high power circuit can be made and broken safely.

It is also an object of the invention to provide means which will effect a rapid connection or make of the connector without the need of the presence of a high energy arc.

It is also an object of the invention to provide a rapid disconnection or break of the connection.

It is also an object of the invention to incorporate a design which will afford electrical connection of the receptacle connector directly to the circuit without secondary elements.

It is also an object of the invention to provide means to block creation or continuance of an arc quickly upon disconnection of the circuit.

It is also an object of the invention to provide insulation and isolation of the bushing connector until immediately prior to contact, thus limiting the arcing time.

It is also an object of the invention to provide blockage of gas escape from the receptacle immediately upon contact disconnection.

These and other objects, features and advantages of the invention will become apparent from the following specifications viewed in conjunction with the accompanying drawings.

DRAWING FIGURES

In the drawings, closely related figures have the same numbers but different alphabetic suffixes.

FIG. 1 shows the terminator contact assembly while housed in the terminator assembly, and the said terminator assembly fully inserted into the receiving connector bushing assembly and represents the disclosed species.

FIG. 2 shows the terminator contact assembly.

FIGS. 3A and 3B show two embodiments of my invention in the initial starting position with no terminator contact assembly installed. FIG. 3B is the preferred embodiment.

FIG. 3C shows the invention with the terminator contact assembly fully inserted in normal position.

FIGS. 4A to 4C show the invention at specific positions of the terminator contact assembly.

REFERENCE NUMERALS IN DRAWING

| | |
|---|---|
| 10 Bushing Assembly | 22 Spring Retainer |
| 12 Bushing Insert Body | 24 Arc Snuffer |
| 14 Bushing Insulation | 26 End Plug |
| 16 Bushing Contact | 40 Terminator Contact Assembly |
| 18 Slide | 42 Arc Follower |
| 19 Vent Hole | 44 Terminator Contact |
| 20 Coil Spring | 50 Terminator Assembly |
| 21 Flapper Valve | 60 Connecting Conductor |

DESCRIPTION OF DRAWINGS

FIG. 1 shows my invention bushing assembly 10 in a normally installed position and including insertion of the loadbreak elbow or terminator assembly 50 fully installed. Terminator assembly 50 includes an electrical connection within its elastic housing to connect terminator contact 44 and the insulated conductor to be connected to the circuit designated connecting conductor 60. Bushing assembly 10 is connected to a transformer or the like at its remote end with end plug 26 to a stud which provides a connecting member to connect the remainder of the circuit within a transformer or the like. FIG. 2 illustrates terminator contact assembly 40, which consists of arc follower 42 normally manufactured from an arc suppressant type of material, and terminator contact 44 which connects connecting conductor 60 to bushing contact 16 within bushing assembly 10. Terminator assembly 50 is normally manufactured to the previously mentioned ANSI Standards in order to have interchangeability dimensions and configurations compatible with bushing assemblies which are provided by many different manufacturers. These interchangeability requirements include the configuration and dimensions of the total terminator assembly and the location and configuration of terminator contact assembly 40 housed within terminator assembly 50. It can be seen that this would be a critical requirement in order to insure that the contact portion truly will complete the circuit when terminator assembly 50 is inserted into bushing assembly 10. Additionally, both the terminator and the bushing must be insulated against external environments, and terminator assembly 50 must fit snugly about bushing insulation 14 in order to effect proper insulation and protection of high voltages. Therefore, the dimensions of bushing insert body 24 and bushing insulation 14 must be compatible to receive the interchangeable terminators presently being produced in the field.

FIG. 2 illustrates the configuration of terminator contact assembly 40. This assembly consists of a cylindrically shaped arc follower 42, generally composed of an arc suppressant material and generally beveled on the end to easily allow entrance of terminator contact assembly 50 into bushing assembly 10. Arc follower 42 is mechanically secured to terminator contact 44, which is made from a conductive metal, preferably copper. The drawing illustrates a broken section at the end of terminator contact 44; however, most generally this section ends with a threaded portion which mechanically and electrically secures into a connection device within terminator assembly 50. It can be seen that other connection means can be afforded.

Figures 1, 2:
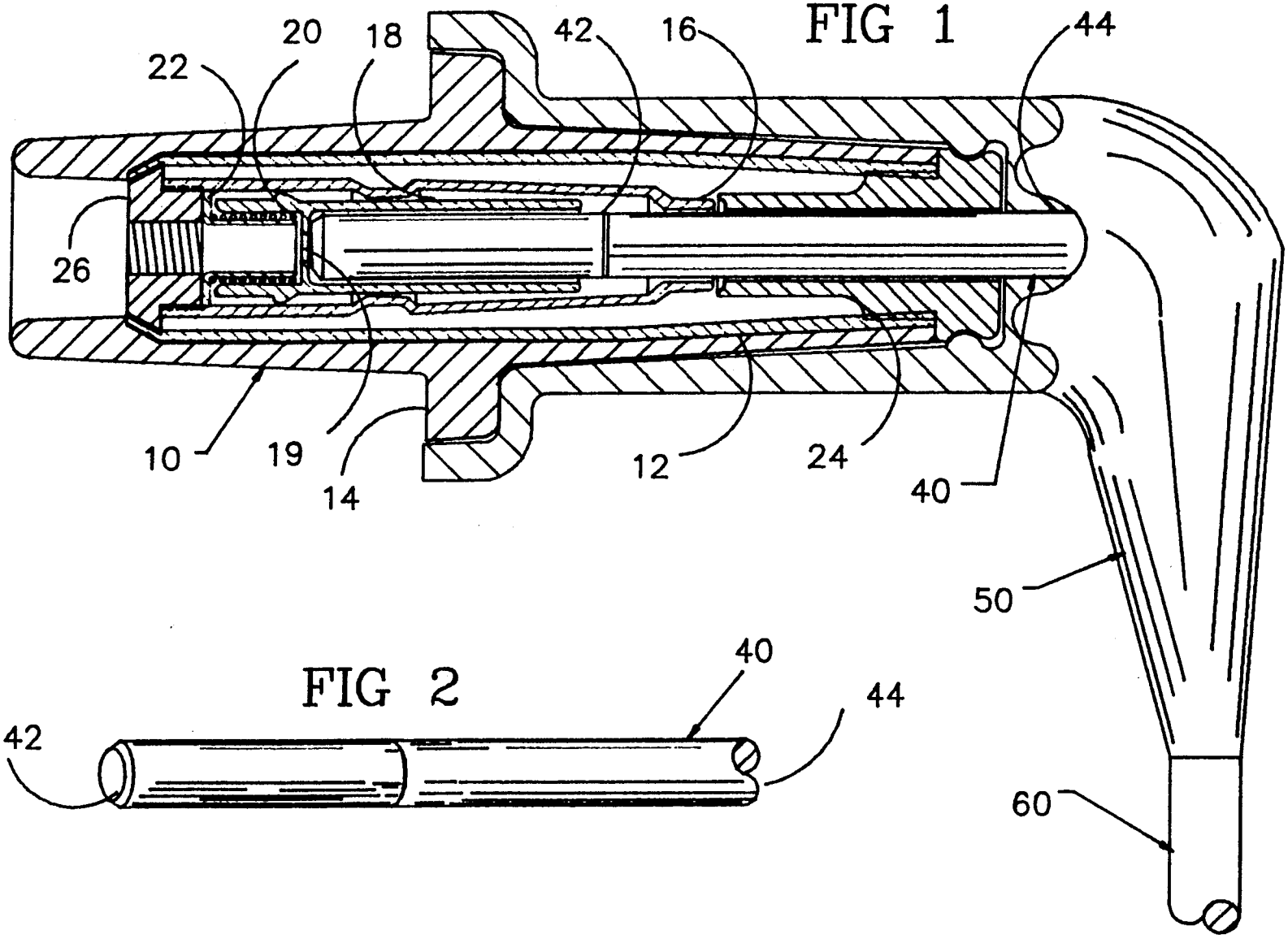

Tubular slide 18 is fabricated from an electrically insulative type material, and it is preferable that this material be of the arc suppressant type. Slide 18 is cylindrical in shape and hollow in the center with a cam portion located circumferentially about the external surface and in close proximity to one end of the cylinder. The hollow portion is capable of accepting arc follower 42 with a minimum of dimensional clearance, and a barrier is located within the hollow portion to provide a stop for arc follower 42 at a predetermined point. The barrier also includes vent hole 19 which will prevent excessive air compression to build up within the hollow chamber as terminator contact assembly 40 enters. Coil spring 20 is located in the hollow on the opposite side of the barrier, and is of sufficient length to produce force during the entire length slide 18 will be allowed to traverse. Coil spring 20 is fabricated from a stainless steel type of metal, or any other material that has adequate spring force and protection against long term corrosion. Coil spring 20 is held in place on the end opposite its entrance into the hollow of slide 18 with spring retainer 22, fabricated from an insulative material, but not necessarily arc suppressant. Spring retainer 22 in this embodiment is shown as being held in place at the base of bushing contact 16 just immediately to bushing contact 16 being mechanically connected to end plug 26.

End plug 26 is fabricated from a conductive metal and is generally cylindrical in shape. One end of the part has external threads or any other means on which bushing contact 16 can be mechanically and electrically secured. The internal diameter of end plug 26 incorporates a threaded portion which will accept a male stud which provides a connecting member to complete the circuit to a transformer or the like. The opposite end of end plug 26 may incorporate a frustro-conical surface which will allow bushing insert body 12 to be secured by spinning, threading or other means, thus completing the mechanical assembly of the operating portions of bushing assembly 10. While this represents the preferred embodiment of my invention, it can be readily seen that other appropriate means of attachment can be made.

Upon completion of the mechanical assembly for the operating portions of bushing assembly 10, bushing insulation 14 can then be applied by directly molding or applying elastic insulative material external to bushing insert body 12. It can also be performed by molding a separate portion of bushing insulation 14 and inserting the mechanical portions of bushing assembly 10 within bushing insulation 14. This assembly will now complete, in this embodiment, bushing assembly 10 and will prepare it to function with a completed terminator assembly 50.

Figure 3A:
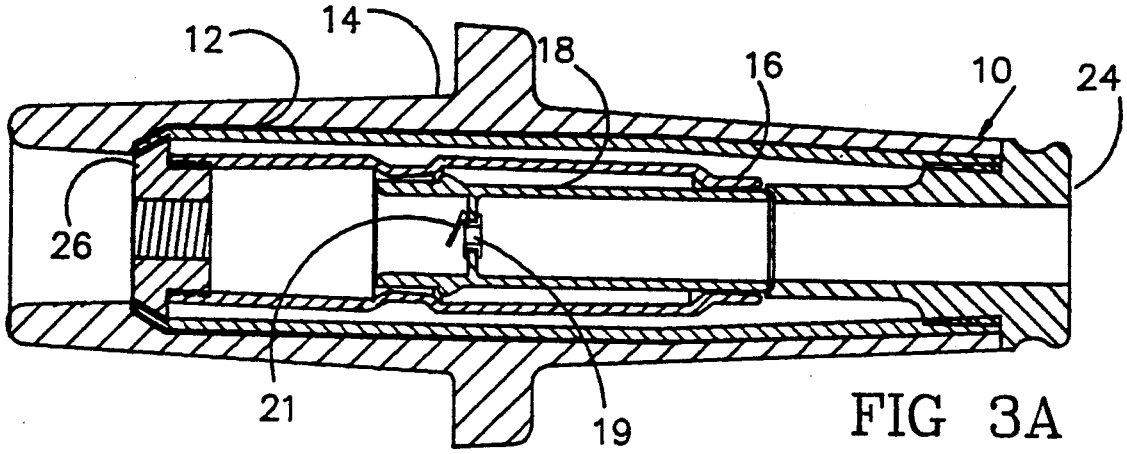
In FIG. 3B, arc snuffer 24 is located within bushing assembly 10 and normally secured to bushing insert body 12. Arc snuffer 24 is normally made of an arc suppressant material, and generally works in cooperation with arc follower 42 to produce gasses which suppress arcs. As mentioned, these gasses are formed when the energy of the arc strikes the material which is generally used in arc snuffer 24 and arc follower 42. Bushing contact 16 is located within bushing assembly 10 so as to receive terminator contact assembly 40 after it has entered and has been guided through arc snuffer 24. In some cases, bushing contact 16 may be directly secured to bushing insert body 12 or, as previously explained, is movable within bushing assembly 10 and connected indirectly to end plug 26 to complete the circuit with at least one more member. While this can be accomplished with my invention, my preferred embodiment shows bushing contact 16 secured directly to end plug 26, thereby eliminating at least one, and possibly two, contact elements in order to complete the circuit. Also, my invention allows bushing contact 16 to remain stationary, requiring no movement to effect rapid connection and disconnection. This is desirable because it eliminates the need for more contact surfaces, thus offering greater reliability and less electrical resistance. Bushing contact 16 is configured so as to provide adequate contact surfaces to complete a high current circuit with terminator contact 44, and also is configured to contain slide 18, whose function will be explained shortly. Bushing contact 16 is cylindrical and tubular in shape, however tapers in diameter with the smaller diameter located to engage terminator contact 44 upon installation of terminator assembly 50. Approximately centrally located, but dimensioned to comply with design and interchangeability requirements, is located an inner circumferential depression which cooperates with an outer circumferential cam on slide 18. Bushing contact 16 is slit longitudinally in at least three places, preferably as much as four, equally spaced, with the slit initiating at the smaller diameter and ending at a line in proximity to, but not at, the larger diameter. The fingers of the smaller diameter function as the contact surfaces previously mentioned, and are formed to engage terminator contact 44 with a spring force, and resist spreading forces.
Figure 3B:
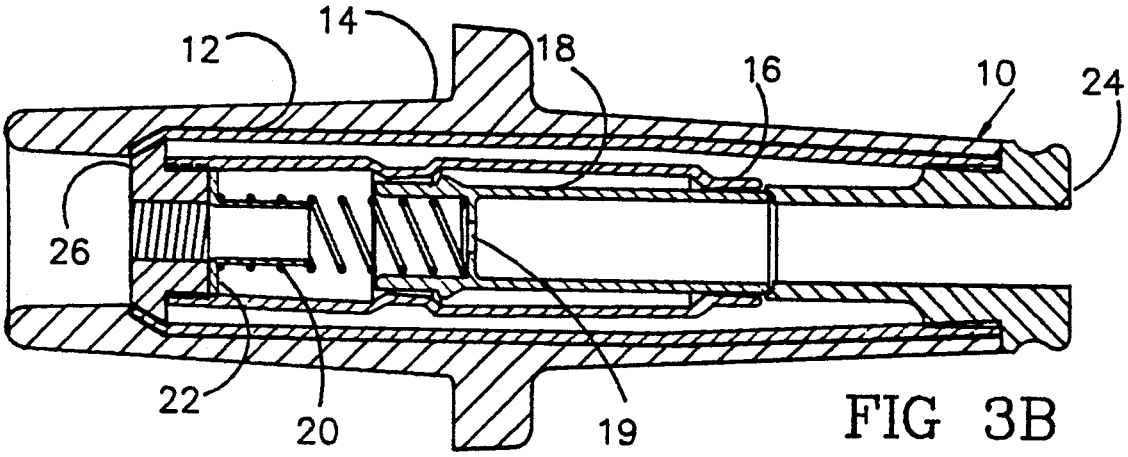
Figure 3C:
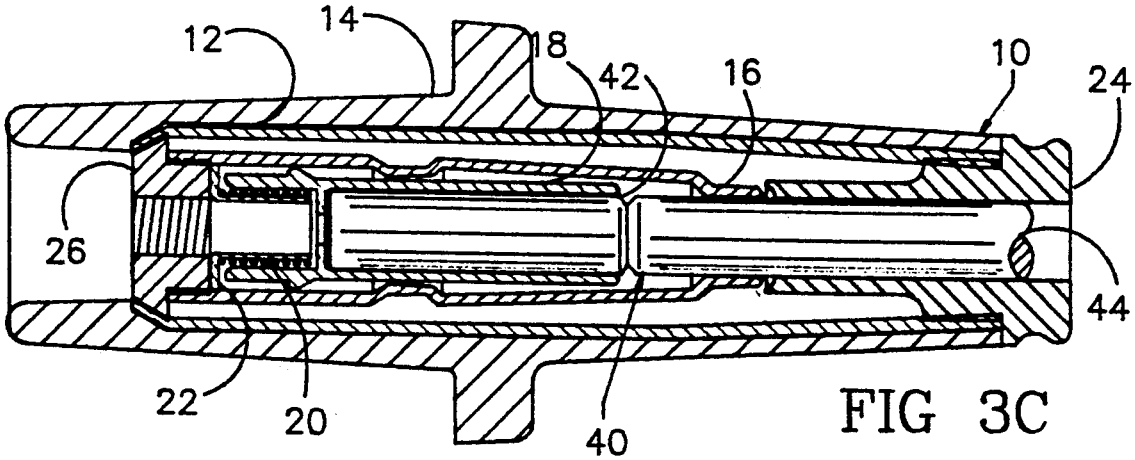

FIGS. 3A and 3B represent my invention with slide 18 and associated members in the position that they would normally be before terminator assembly 50 is inserted into bushing assembly 10. FIG. 3B represents the preferred embodiment which employs coil spring 20 to effect movement of slide 18 in a manner which will abut the end of slide 18 against the internal end of arc snuffer 24. FIG. 3A illustrates a replacement of coil spring 20 and also its locating component retainer 22 with flapper valve 21 positioned in vent hole 19 of slide 18 in such a manner that it will allow transfer of air only from the hollow cylindrical portion of slide 18 into the end of bushing assembly 10 which incorporates end plug 26. It will be seen in our Description of Operation that upon normal removal of terminator assembly 50 from bushing assembly 10, the slide will assume the same position as described in FIG. 3B. FIG. 3C simply illustrates the position of slide 18 when terminator assembly 50 is totally inserted into bushing assembly 10; however, terminator body 50 has been removed from the drawing to more clearly allow a description of the operation of my invention.

DESCRIPTION OF OPERATION

Figure 4A:
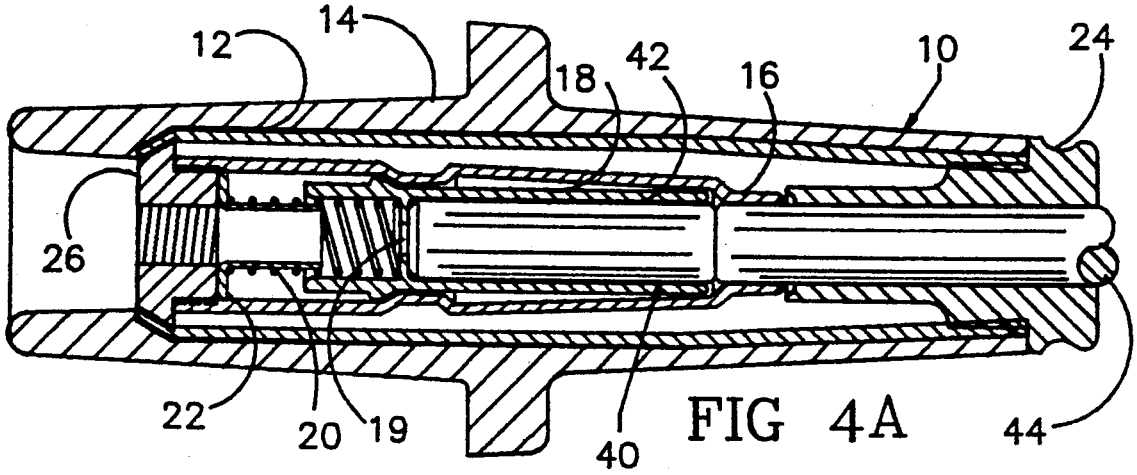

In describing the operation of my invention, primary references will be made to FIGS. 4A, B and C. However, initially, please refer to FIGS. 1 and 3B. As previously mentioned, FIG. 3B represents my invention in the preferred embodiment at a normal position and prepared to accept terminator assembly 50 to allow a loadmake or closure of the circuit. Terminator 50 is positioned to allow terminator contact assembly 40, contained therein, to enter bushing assembly 10 at the opening of arc snuffer 24. As terminator assembly 50 enters bushing assembly 10, terminator contact assembly 40 moves inward to bushing assembly 10.

Figure 4B:
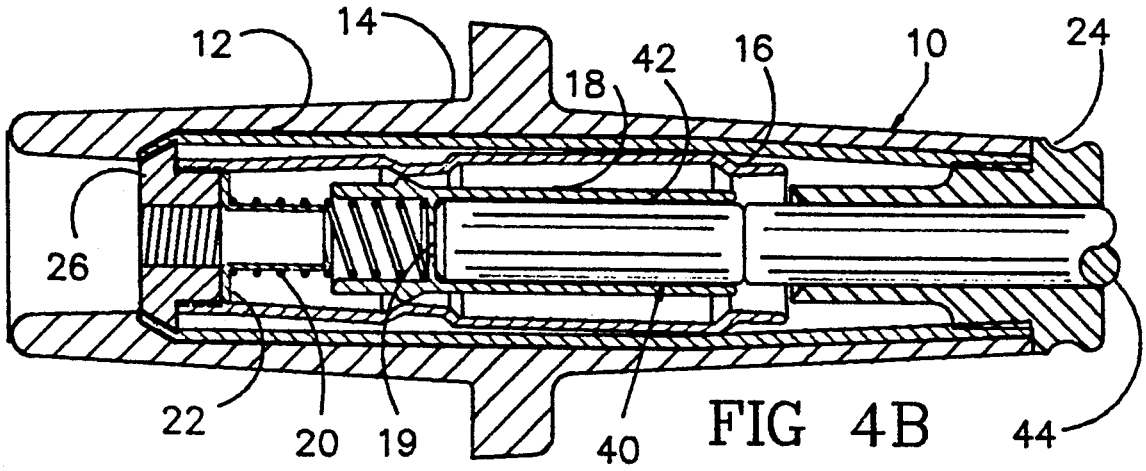
Figure 4C:
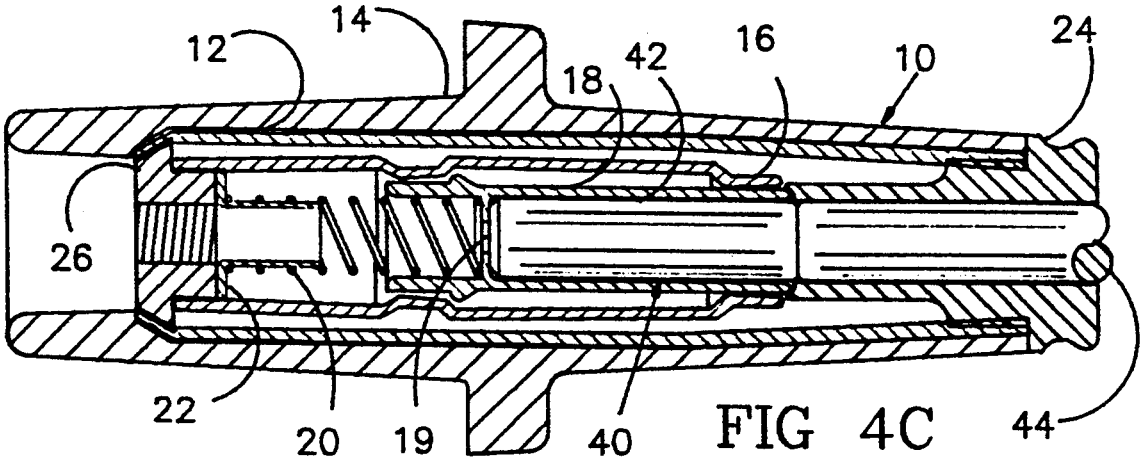

Please now refer to FIG. 4C which represents the position of terminator contact assembly 40 as it penetrates into bushing assembly 10 far enough to allow the end of arc follower 42 to bottom within the barrier located in slide 18. Also, as previously mentioned, the drawing of the remainder of terminator assembly 50 is omitted in order to more clearly describe the operation. Please note that prior to, and at the point that terminator contact assembly 40 abuts the barrier in slide 18, bushing contact 16 is isolated and insulated from terminator contact 40 with the insulative portion of slide 18 as it blocks the contact surface, and also affords a blockage of arcing through the air by abutting against arc follower 24. This action provides insulation and minimizes any arcing that might occur upon loadmake, or more critically, fault close operations.

As terminator contact assembly 40 continues to penetrate bushing assembly 10, we refer now to FIG. 4B. Please not that as slide 18 is now forced to move in the same direction as terminator contact assembly 40, the cam portion about the circumferential outer diameter of slide 18 contacts a depression or fabricated groove in contact 16, which immediately raises the contact portions of bushing contact 16 in the proximity of terminator contact 44 to further provide air gap distance and prevent arcing. As this action is performed, the conductive portion of terminator contact 44 begins to enter the area immediately next to the portion of bushing contact 16 which will eventually result in circuit closure. This action, with the circumferentially formed cam on slide 18 and depression on bushing contact 16, rapidly further opens the contact; however, as terminator contact assembly 40 penetrates further, the circumferentially formed cam on slide 18 passes the end of the depression in bushing contact 16 and allows the contact to rapidly close. Please refer to FIG. 4A to observe the closure of bushing contact 16 on terminator contact 44. As the cam rides off the depression on bushing contact 16, a very rapid closure is performed by the contact portions snapping down onto the terminator contact 44. As the terminator contact assembly 40 continues moving inward, adequate surface area remains to allow the terminator contact assembly 44 to completely enter the bushing and allow the terminator assembly 50 to seat and lock on the bushing assembly 10 as shown in FIG. 3C and FIG. 1. It can be seen that this action provides a rapid contact and also provides isolation and insulation of the closure of the circuit until immediately prior to positioning of the terminator contact assembly 40.

Please now refer to an alternate construction of my invention as shown in FIG. 3A which allows another means for cooperation of the terminator contact assembly 40 with slide 18. This embodiment depicts flapper valve 21 situated within vent hole 19 and replaces the spring action provided by spring 20. It can be seen that upon connection of the circuit, as just described, the spring action is not required; however, the cavity within slide 18 must be open so as to allow terminator contact assembly 40 to totally bottom within slide 18 prior to movement of the slide. Thus, flapper valve 21 is located to allow passage of air out of the cavity of slide 18 into the section in bushing assembly 10 which will allow air to pass into the remaining volume of bushing assembly 10 without creating pressure in slide 18 which will affect its movement prior to bottoming of terminator contact assembly 44. The description, therefore, of loadmake or circuit completion is identical in this design embodiment.

Again, we refer to FIG. 3C and FIGS. 4A, B and C in describing the operation of my invention upon loadbreak or circuit disconnection. FIG. 3C depicts the position of the terminator contact assembly 44 when normally connected to the circuit and in the fully installed and locked position. Please note that in this position, terminator contact 44 is electrically connected to bushing assembly 10 at the contact surfaces which bushing contact 16 affords immediately in proximity to the arc snuffer 24 as shown in FIG. 4A. As terminator assembly 50 is removed from bushing assembly 10, depicted in FIG. 4B, the force of spring 20 moves slide 18 in concert with terminator contact assembly 40 upon withdrawal. In FIG. 4B, as slide 18 continues moving in concert with terminator contact assembly 40, the circumferentially located cam meets the circumferential depression on bushing contact 16 and acts to spread the contact portion away from terminator contact 44, thus disconnecting the surface and effecting a rapid break or disconnection as the cam on slide 18 rides on the depression on bushing contact 16. As terminator contact assembly 40 continues to exit bushing assembly 10, slide 18 continues to follow terminator contact assembly 40 while keeping the circuit disconnected between bushing contact 16 and terminator contact 44.

In FIG. 4C, the circumferentially located cam on slide 18 then exits the depression on bushing contact 16. At this time, the design affords the end of slide 18 to abut arc snuffer 24 and create an insulative barrier between bushing contact 16 and terminator contact assembly 40. The insulative barrier insures that a positive disconnection is made, and prevents direct arcing between bushing contact 16 and terminator contact 44. The abutment of slide 18 against arc snuffer 24 provides an air blockage which acts to snuff any arcs which might have been initiated upon initial break. It can therefore be seen that the remainder of withdrawal of terminator contact 40 is allowed without further arcing, and the blockage of gasses upon the abutment of slide 18 to arc snuffer 24 prevents any ionized gasses from exiting the bushing and creating an open arc in the air.

While FIGS. 1 and 3B illustrate the preferred means for cooperation of the terminator contact assembly 40 with slide 18, an alternate means is shown in FIG. 3A. Upon withdrawal of terminator contact assembly 40 within the cavity of slide 18, a rush of air will tend to pass through vent hole 19 to fill any space which might be vacated by the exiting of terminator contact assembly 40 in the cavity of slide 18. This air movement will tend to close the flapper which is hinged on flapper valve 21, thereby providing a relative seal between the chamber of slide 18 containing terminator contact assembly 40 and the remainder of the pressure within bushing assembly 10. This will create a lower pressure within the circuit cavity which contains terminator contact assembly 40 in relation to the pressure in the remainder of bushing assembly 10. This pressure will act in the same manner as previously described with spring 20 and maintain slide 18 in immediate and intimate contact with terminator contact assembly 40 upon its exit. Operation of the break, in this case, will remain the same as previously described. It should be recognized that upon completion of the break or disconnection of the circuit with each described embodiment, when slide 18 is abutted against the end of arc snuffer 24, the circumferentially located cam on slide 18 rides off the depression on contact 16, and is retained in its abutted position by the action of the depression on contact 16 against the end of the cam on slide 18. This retaining feature automatically assures that slide 18 will be in the proper position to accept a circuit close or loadmake, as previously described and isolates the bushing contact 16 to the environment.

While there has been described preferred embodiments of this invention, it is understood that modifications may be made therein, and it is intended to cover in the appended claims all such modifications which fall within the true spirit and scope of such claims.

SUMMARY, RAMIFICATIONS AND SCOPE

Accordingly, it can be seen that my invention provides a safe and reliable high voltage power electrical connection which can be connected and disconnected by hand. It provides facility to design a loadbreak bushing connector which is compatible for use with all other loadbreak terminals presently being employed in the field, and a design which would make the loadbreak bushing easily installable in existing transformers, for interface dimensions, as well as for size of the space allowed.

It affords rapid connection of the circuit and provides an insulative and isolating layer of material between the circuit contacts just prior to the connection. This rapid connection and insulation minimizes arcing and prevents pressure build-up and deterioration of the connector system.

It provides a rapid disconnection of the circuit to minimize arcing, and also provides a blockage of the arc, both with an insulating portion and with a means to block any air path between the contacts upon disconnection or break of the circuit.

It provides a reliable disconnection of the circuit when the amperage is not sufficient to create arc snuffing gasses.

The design allows stationary securement of the bushing contact within the bushing, and also allows it to be connected directly to the terminal which connects to the transformer or other parts of the circuit. Actually, the construction of the contact can also be made to be incorporated as one piece with the electrode that connects to the remainder of the circuit.

The invention also provides a blockage to the electrical contact within the bushing to the external environment, both electrically and environmentally, which prevents ionized gasses, upon disconnection, from exiting the bushing into the open air and creating open arcs.

Although the description above contains many specific details, these should not be construed as limiting the scope of the invention, but as providing illustrations of some of the presently preferred embodiments of this invention. For example, movement of the slide can be effected by strategically locating elastic rings within the inner diameter of the slide which mate with the arc follower on the terminator contact assembly. The rings can cooperate in moving the slide in conjunction with the arc follower upon insertion or withdrawal of the terminator assembly. Also, movement of the contact portions of the contact assembly can be effected by other members within the bushing assembly which are activated by the entrance of the terminator contact assembly through cams located within the bushing housing.

Also of note, the invention can be applied to any switching function for high power circuits, for example, in switching enclosures and in overhead power distribution switches adequately protected against environment and intrusion.

Thus, the scope of the invention should be determined by the appended claims and their legal equivalents rather than the examples given.

I claim:

1. A connector for receiving a terminator having a conductive electrode, said connector comprising:

an electrode for receiving said terminator electrode through an opening at one end of said connector and for engaging said terminator electrode to complete a current transmitting path between said connector and said terminator electrode;

a conductive body within said connector for completing said current transmitting path from said receiving electrode to a connecting member at the remote end of said connector;

a housing surrounding said receiving electrode and said conductive body to produce an otherwise closed cavity therein;

a dielectric member adjacent to said opening of said connector for receiving said terminator electrode prior to entry and after removal of the terminator electrode from said receiving electrode;

first means in and forming part of said connector to separate an electrical contact portion of said receiving electrode away from said terminator electrode upon initial entrance of said terminator electrode into said connector and said first means subsequently rapidly releasing said contact portion of said receiving electrode to electrically engage said terminator electrode upon further insertion of said terminator electrode;

second means in and forming part of said connector to rapidly separate said contact portion of said receiving electrode from said terminator electrode upon removal of said terminator electrode from an installed position in said connector, thereby disconnecting said current path and then blocking any resultant arcing path from said receiving electrode to said terminator electrode;

means in said connector to block any resultant arcing path from said receiving electrode to the surrounding environment upon removal of said terminator electrode from the installed position in said connector.

2. The connector as claimed in claim 1, wherein said dielectric member is fabricated of an arc quenching material.

3. The connector as claimed in claim 1, wherein said first means to separate the electrical contact portion of said receiving electrode comprises a tubular dielectric member which cooperates with said terminator electrode.

4. The connector as claimed in claim 3, wherein said first means to separate comprises said tubular member and a spring to assist said tubular member in cooperating with said terminator electrode.

5. The connector as claimed in claim 1, wherein said means to block any resultant path from said receiving electrode to said terminator electrode comprises a tubular member which cooperates with said terminator electrode.

6. The connector as claimed in claim 5, wherein said means to block any resultant path from said receiving electrode to said terminator electrode comprises said tubular member and a spring to assist said tubular member in cooperating with said terminator electrode.

7. The connector as claimed in claim 1, wherein said means to block any resultant arcing path from said receiving electrode to the surrounding environment comprises a tubular member which cooperates with said terminator electrode.

8. The connector as claimed in claim 7, wherein said means to block any resultant arcing path from said receiving electrode to the surrounding environment comprises said tubular member and a spring to assist said tubular member in cooperating with said terminator electrode.

9. A receiving connector for a loadbreak terminator having a central conductive, rod shaped electrode with an arc follower at the exposed end thereof; said connector comprising:

an annular receiving electrode for receiving said terminator electrode through an open face at one end of said connector and for engaging said terminator electrode to complete a current transmitting path between said electrodes;

a conductive body in said connector for completing a current transmitting path from said receiving electrode to a connecting member at the remote end of said connector;

a housing surrounding said conductive body to enclose said conductive body and produce an otherwise closed cavity therein;

an arc suppressant member adjacent to the open face of said connector for receiving said terminator electrode prior to entry and after removal of the terminator electrode from said receiving electrode;

first means in and forming part of said connector to separate an electrical contact portion of said receiving electrode away from said terminator electrode upon initial entrance of said terminator electrode into said connector and said first means subsequently rapidly releasing said contact portion of said receiving electrode to electrically engage said terminator electrode upon further insertion of said terminator electrode;

second means in and forming part of said connector to rapidly separate said contact portion of said receiving electrode from said terminator electrode upon removal of said terminator electrode from an installed position in said connector, thereby disconnecting said current path and then blocking any resultant arcing path from said receiving electrode to said terminator electrode;

means in said connector to block any resultant arcing path from said receiving electrode to the surrounding environment upon removal of said terminator electrode from the installed position in said connector.

10. The connector as claimed in claim 9, wherein said first means to separate the electrical contact portion of said receiving electrode comprises a tubular dielectric member which cooperates with said terminator electrode.

11. The connector as claimed in claim 10, wherein said first means to separate comprises said tubular member and a spring to assist said tubular member in cooperating with said terminator electrode.

12. The connector as claimed in claim 9, wherein said means to block any resultant path from said receiving electrode to said terminator electrode comprises a tubular member which cooperates with said terminator electrode.

13. The connector as claimed in claim 12, wherein said means to block any resultant path from said receiving electrode to said terminator electrode comprises said tubular member and a spring to assist said tubular member in cooperating with said terminator electrode.

14. The connector as claimed in claim 9, wherein said means to block any resultant arcing path from said receiving electrode to the surrounding environment comprises a tubular member which cooperates with said terminator electrode.

15. The connector as claimed in claim 14, wherein said means to block any resultant arcing path from said receiving electrode to the surrounding environment comprises said tubular member and a spring to assist said tubular member in cooperating with said terminator electrode.

* * * * *

UNITED STATES PATENT AND TRADEMARK OFFICE

CERTIFICATE OF CORRECTION

PATENT NO. : 5,266,041

DATED : December 9, 1993

INVENTOR(S) : Carlo B. Deluca

It is certified that error appears in the above-indentified patent and that said Letters Patent is hereby corrected as shown below:

Column 1, line 32, change "arching" to --arcing--.
Column 1, line 49, change "23" to --1973--.
Column 2, line 1, change "exists" to --exits--.
Column 2, line 5, change "exists" to --exits--,
Column 6, line 33, change "not" to --note--.

Signed and Sealed this

Tenth Day of May, 1994

Bruce Lehman

*Attest:*

BRUCE LEHMAN

*Attesting Officer*

*Commissioner of Patents and Trademarks*